United States Patent [19]

Altman et al.

[11] 4,267,609

[45] May 19, 1981

[54] GASKET ASSEMBLY FOR COUPLING DRAINAGE OUTLET OPENINGS IN BATHTUB LINER INSTALLATIONS

[75] Inventors: Gilbert Altman, Bronx, N.Y.; Gerard Bellasalma, West Caldwell, N.J.

[73] Assignee: Thermasol Ltd., Leonia, N.J.

[21] Appl. No.: 970,365

[22] Filed: Dec. 18, 1978

[51] Int. Cl.[2] ..... A47K 3/00

[52] U.S. Cl. ..... 4/580; 277/88; 277/212 FB; 4/584; 4/596

[58] Field of Search ..... 4/173, 191, 252 A, 145, 4/146; 74/18.2; 277/88, 212 FB

[56] References Cited

U.S. PATENT DOCUMENTS

| | | | |
|---|---|---|---|
| 3,045,254 | 7/1962 | Cook et al. | 4/173 |
| 3,593,347 | 7/1971 | Nemiroff | 4/173 |
| 3,614,793 | 10/1971 | Nemiroff | 4/173 |
| 3,965,493 | 6/1976 | Bemis | 4/252 A |
| 4,067,071 | 1/1978 | Altman et al. | 4/145 |

FOREIGN PATENT DOCUMENTS

| | | | |
|---|---|---|---|
| 563763 | 8/1975 | Switzerland | 4/173 |

*Primary Examiner*—Henry K. Artis

*Attorney, Agent, or Firm*—Lerner, David, Littenberg & Samuel

[57] ABSTRACT

A gasket assembly is provided for coupling the drainage outlet openings of a bathtub and of a plastic liner installed within the bathtub for renovating the latter. The gasket assembly includes a hollow cylindrical body inserted in the space between the bottom wall of the plastic liner and the bottom wall of the bathtub, and having flanges at its upper and lower ends for making sealed connections with the drainage outlet opening of the bathtub and the overlying outlet opening of the plastic liner. The gasket body is made of elastomeric material and has an accordion-pleated side wall so that it is stretchable and compressible and therefore adaptable to bathtub installations of differing sizes. One-way valve means are also provided on the gasket body for draining out water which may accumulate in the space between the plastic liner bottom wall and the bottom wall of the bathtub.

14 Claims, 5 Drawing Figures

GASKET ASSEMBLY FOR COUPLING DRAINAGE OUTLET OPENINGS IN BATHTUB LINER INSTALLATIONS

The present invention relates to improvements in plastic liner assemblies for covering over installed bathtubs and the walls and ceiling of tub recesses or alcoves, for the purpose of refurbishing and renovating the same. The invention relates particularly to gasket means for coupling the water outlet openings of the bathtub liner to the drainage outlet opening of the existing bathtub and for preventing the accumulation of waste water which may have leaked or condensed in the space between the bathtub liner and the existing bathtub.

The liner assembly disclosed herein is of the type shown and described in U.S. Pat. No. 4,067,071 issued to the assignee of this application. Such liner assemblies include a plastic shell bathtub liner which is inserted into an existing bathtub which has become worn, damaged, or outmoded, to provide a new surface finish and/or a modern design for the original bathtub, for purposes of renovation or redecoration. The liner assemblies often also include plastic wall liner panels which are secured to and overlie the tiled walls of the alcove or recess in which the existing bathtub has been installed, the wall liners usually matching the material of the bathtub liner in color and texture.

The plastic shell bathtub liner is made of a selected size and shape so that it may be inserted and installed within the tub cavities of most standard bathtubs which vary somewhat in size. For this reason, when the bathtub liner is installed, there is a space between the walls of the plastic liner and those of the existing bathtub. Particularly, at least a portion of the bottom wall of the plastic liner shell is spaced above the bottom wall of the existing bathtub, so that there is a space therebetween.

When the plastic liner shell is in use within the bathtub, the plastic liner is filled with water for bathing purposes, and is, of course, then necessary to provide means for draining the water from the liner. The liner is therefore provided with an outlet opening in its bottom wall, which outlet opening must be placed in communication with the existing drainage outlet opening of the original bathtub. Since the liner outlet opening is often spaced above the drainage outlet opening of the bathtub, various coupling means have been provided to connect the two outlet openings, but these have generally been found to have a number of drawbacks, being expensive in manufacture, time consuming in installation, incapable of providing efficient sealing about the outlet openings, and incapable of being used in tub installations of different sizes.

It is an object of the present invention to provide a gasket assembly for coupling the outlet opening of a plastic bathtub liner to the drainage outlet opening of the existing bathtub, which gasket assembly includes a hollow cylindrical gasket body made of elastomeric material and of sufficient flexibility to be stretched or compressed, so that a single gasket of uniform size may be used in tub installations of various sizes and shapes, regardless of variations in the spacing between the bathtub liner and the existing bathtub.

Another object of the invention is the provision of a gasket assembly of the type described which includes means for providing effective water-tight seals around the liner and bathtub outlet openings so as to permit free fluid passage from one opening to the other without any leakage of water therefrom.

In use of the liner assembly, water tends to condense in the spaces between the liner panels and the underlying bathroom walls and flow or seep downwardly into the space between the bottom wall of the bathtub liner and the bottom wall of the bathtub. Water may also flow to this area from a leak in the overflow outlet aperture of the bathtub liner, or from other sources. This water tends to accumulate and stagnate in the space between the bottom walls of the liner and the bathtub, causing odors, attraction to insects, and hazardous health conditions.

It is another object of the present invention to provide a gasket assembly of the type described which includes a one-way valve arrangement which permits the water accumulated between the bottom walls of the liner and bathtub to enter the interior of the gasket body and then drain out through the coupled drain pipe, while at the same time preventing water from flowing outwardly from the interior of the gasket body.

A further object of the invention is the provision of a gasket assembly of the character described in which the gasket body and its sealing means is molded integrally from elastomeric material, so that the gasket assembly is of simple construction, is easy to install, and is economical in manufacture.

In accordance with present invention there is provided a gasket assembly for use in a bathtub refurbishing installation in which a plastic bathtub liner is installed within the tub cavity of an existing bathtub with at least a portion of the bottom wall of the liner spaced above the bottom wall of the bathtub, and an outlet opening in the plastic liner overlying a drainage outlet opening of the bathtub. The gasket assembly is adapted to couple the outlet openings of the liner and bathtub, and includes a hollow cylindrical gasket body sized to be inserted in the space between the bottom walls of the liner and bathtub. The assembly also includes first sealing means at the upper end of the gasket body for mounting said upper end in communication with the outlet opening of the plastic liner, and second sealing means at the lower end of said gasket body for mounting said lower end in sealed communication with the drainage outlet opening of the bathtub. The gasket body has a side wall made of elastomeric material and being stretchable and compressible, so that the gasket body is adapted for mounting within bathtub installations of differing sizes.

In a preferred form of the invention, the gasket body is molded as an integral one-piece unit with flanges forming part of the first and second sealing means, and the side wall thereof is formed with accordion pleating so that it may be stretched and compressed.

The bathtub refurbishing installation may also include plastic wall liner panels for covering over the walls of the alcove or recess in which the bathtub is mounted, with a space between the wall liner panels and the alcove walls communicating with the space between the bathtub liner and the bathtub. Water which may condense in the space between the wall panels and the alcove wall accumulates in the space between the bottom walls of the bathtub liner and the bathtub. The gasket body also includes one-way valve means in the side wall thereof for admitting such accumulated water to the interior of the cylindrical gasket body from which the water may drain out through the drainage outlet opening of the bathtub.

Additional objects and advantages of the invention will become apparent during the course of the following specification when taken in connection with the accompanying drawings, in which.

Figure 1:
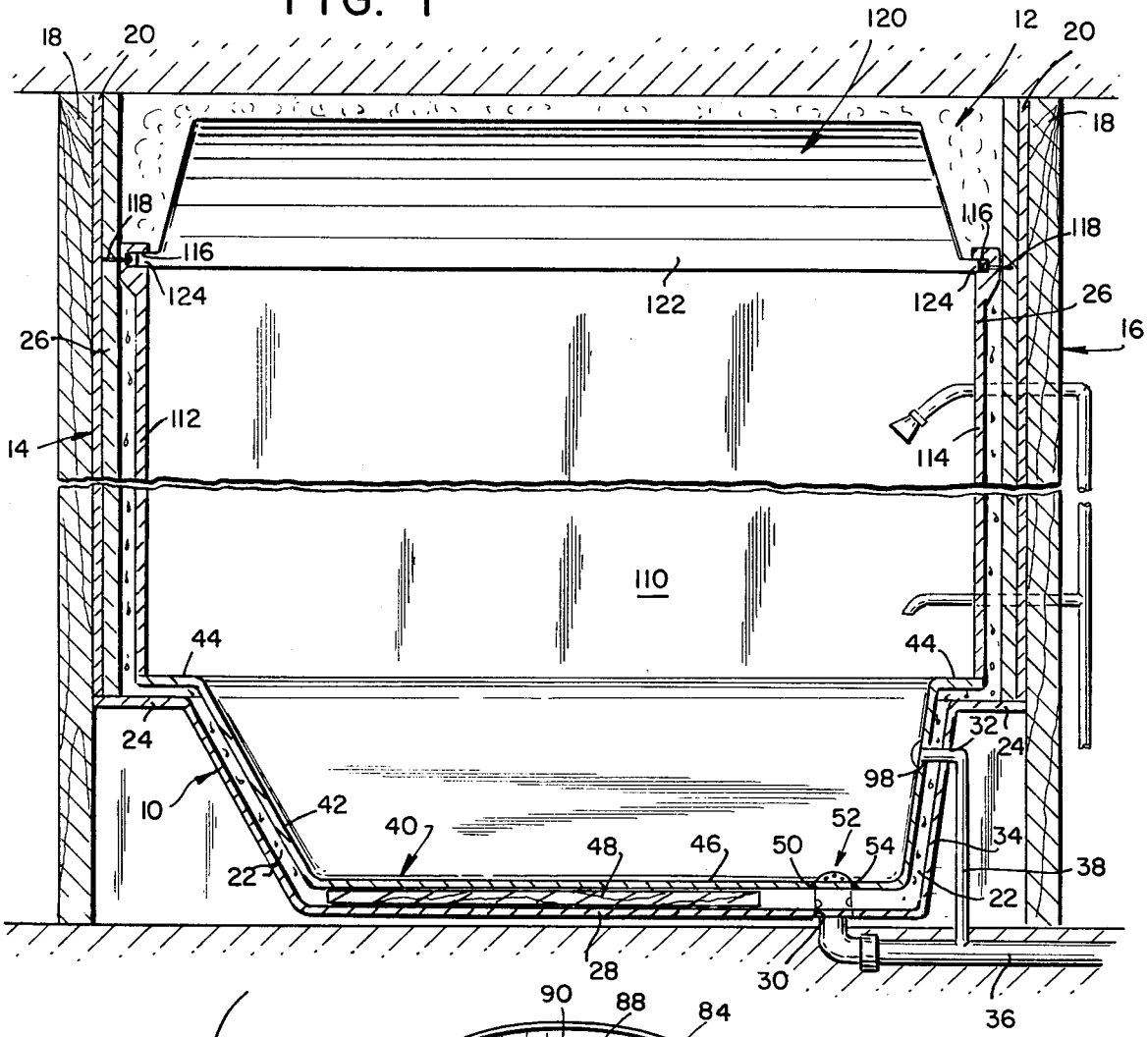
FIG. 1 is a side elevational view of a bathtub and bathtub recess provided with a tub and wall renovating assembly, and including the gasket assembly of the present invention, with portions of the bathtub installation shown in section to reveal inner constructional details.

Referring in detail to the drawings, there is shown in FIG. 1 a typical bathtub installation which is covered and refurbished by the liner assembly made in accordance with the present invention.

The original bathtub 10 is installed in the usual bathroom recess or alcove 12 having side walls 14 and 16, each formed of an upright wooden beam 18 with an overlying panel of sheet rock 20. The bathtub 10 has a tub cavity 22 bordered by an integral horizontal ledge 24, the ends of which are embedded in the walls of the bathtub recess or alcove 12. Above the ledge 24 a layer of tile 26, constituting the original wall surface of the recess or alcove, is cemented over the panel of sheet rock 20. The portion of the ledge 24 at the front of the bathtub, facing outwardly of the recess 12, is formed integrally with the usual vertical skirt (not shown) which extends to the bathroom floor and partially supports the tub. The bathtub 10 is of conventional and standard size and shape, its tub cavity 22 having a bottom wall 28 which is of shallow concave shape in transverse cross-section, and which slopes slightly downwardly toward the outlet end thereof. A conventional drainage outlet opening 30 is provided at the outlet end of the bottom wall 28, and an overflow outlet opening 32 is formed in the end wall 34 of tub cavity 22. In use of the original bathtub, these outlet openings 30 and 32 are connected to drain pipes 36 and 38.

The tub 10 of FIG. 1 is shown fitted with a bathtub liner 40 of plastic material which may be of the type shown in the aforementioned U.S. Pat. No. 4,067,071, and which is employed to refurbish the original bathtub 10. The liner 40 is preferably cast from acrylic plastic reinforced with fiberglass and is formed with a tub portion 42 bordered by an integral horizontally-projecting peripheral flange or ledge 44 which overlies the horizontal ledge 24 of the original bathtub 10. The liner tub portion 42 is made of such dimension that it will fit within most conventional bathtubs which have already been installed and require refurbishing. The length and width of the liner tub portion 42 shown in FIG. 1 are less than the length and width of the tub cavity 22 of the original bathtub 10 so that the end and side walls of the liner tub portion are spaced from the end and side walls of the tub cavity. The bottom wall 46 of the tub liner 40 is reinforced by a panel of wood 48 encapsulated in fiberglass and adhering to the central lower surface of the bottom wall 46. The wood panel 48 rests upon the bottom wall 28 of the tub cavity 22, terminating short of the drainage outlet opening 30, as shown in FIG. 1. Because of the transverse concave shape of the bottom walls of both the original bathtub 10 and the bathtub liner 40, these bottom walls are spaced from each other along both sides of the wood panel 48.

Since in conventional bathtubs the location and size of the drainage outlet opening may vary to some extent, when the bathtub liner 40 is in the process of being installed in the original bathtub 10, an outlet opening 50 is drilled in the liner 40 in registry with the drainage outlet opening 30 of the bathtub 10. The liner outlet opening 50 is coupled to the drainage outlet opening 30 of the bathtub 10 by a gasket assembly 52 of the present invention, in a manner now to be described.

Figure 2:
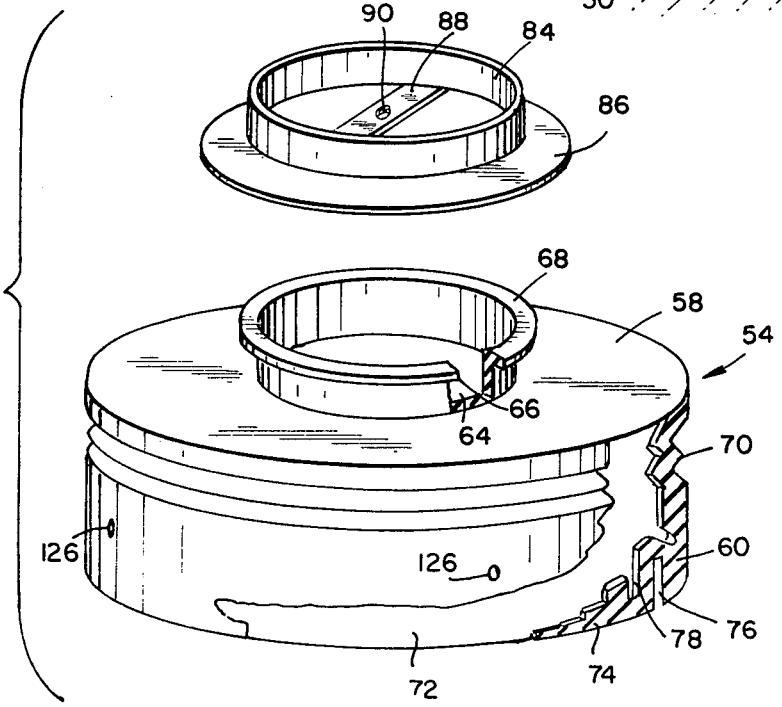
FIG. 2 is an exploded perspective view of the gasket assembly of the present invention.
Figure 3:
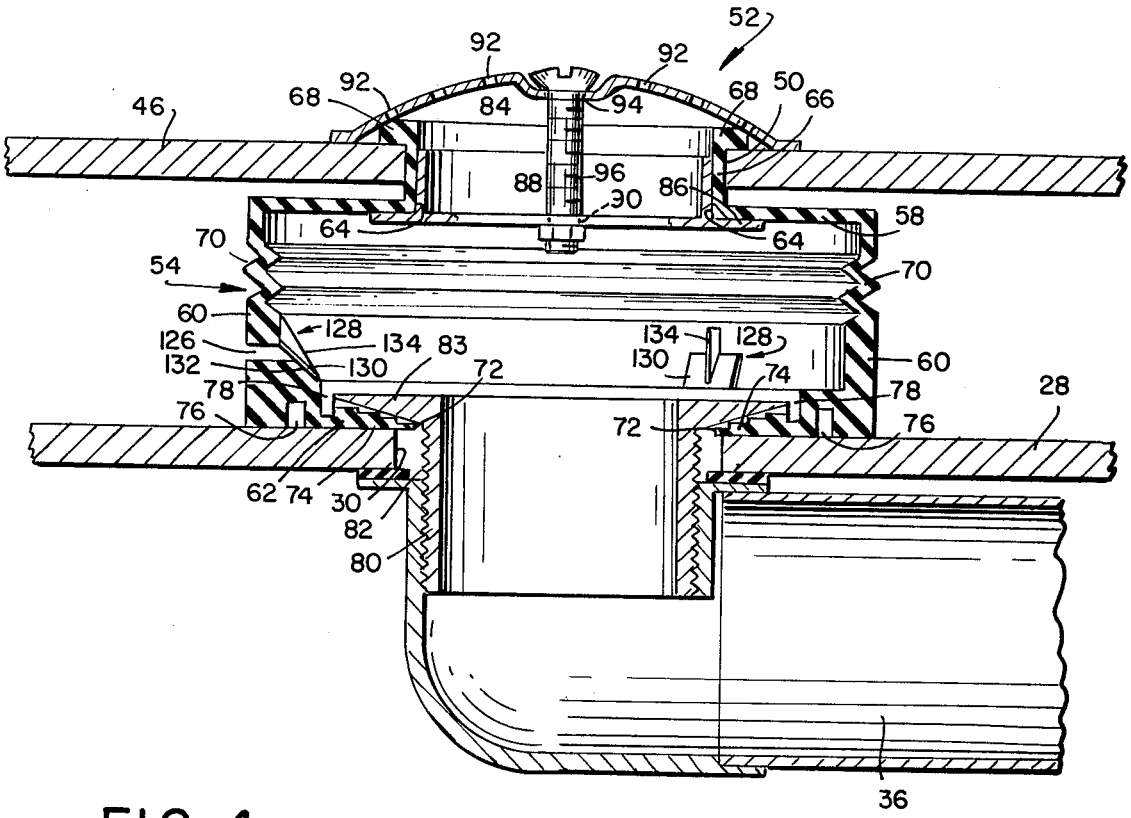
FIG. 3 is a sectional view showing the gasket assembly of FIG. 2 mounted in the bathtub installation between the bottom wall of the plastic bathtub liner and the bottom wall of the bathtub.
Figure 4:
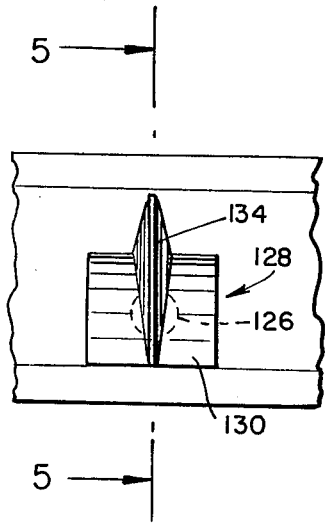
FIG. 4 is an enlarged fragmentary view of a portion of the inner surface of the side wall of the gasket body, showing a flap valve mounted thereon.

As shown in FIGS. 2 and 3, the gasket assembly 52 includes a unitary gasket body 54 made of elastomeric material molded in the form of a cylindrical container having a top wall 58, a side wall 60, and a bottom wall 62. The top wall 58 has a circular central opening 64 bordered by an upstanding flange 66 which terminates in an outwardly-extending perpendicular flange 68. The side wall 60 has an accordion pleated portion 70 which provides flexibility in the side wall and allows the latter to be flexed and compressed. The lower portion of the side wall 60 is thickened and intergrally joins the bottom wall 62 at the thickened outer portion thereof. The bottom wall has a central circular opening 72 and a downwardly-stepped wall portion 74 leading from the thickened outer portion thereof to the central opening 72. An elongated annular groove 76 is formed in the under surface of the bottom wall 62 in the thickened inner portion thereof and an annular groove 78 is also formed in the top surface of the bottom wall immediately inward of the downwardly-stepped wall portion 74. These grooves 76 and 78 provide a large degree of flexibility to the stepped wall portion 74 relative to the side wall 60 of the gasket body.

The original bathtub 10 is provided with the usual drain fitting in the form of a metal sleeve 80 having external threading 82 and terminating at its top in an annular flange 83 which overlies the bottom wall surface of the tub 10. By means of said external threading 82, the sleeve 80 is screwed into an internally-threaded opening in the drain pipe 36. When the tub liner 40 is inserted into the existing bathtub 10, there is a space of approximately one and one-half inches between the bottom wall 46 of said liner 40 and the bottom wall 28 of the tub 10, as shown in FIGS. 1-3, and the gasket body 54 is mounted in this space.

The gasket assembly 52 also includes a metal retainer ring 84 having an annular flange 86 projecting perpendicularly from one end thereof. A flat bar 88 is integral with or affixed to the retainer ring 84 and extends diametrically across the central opening of ring 84. The bar 88 has a central threaded aperture 90. The assembly also includes a convex, perforated strainer plate 92 having a central aperture 94.

The gasket assembly 52 is installed during installation of the bathtub liner 40 into the existing bathtub 10. For this purpose, the drain fitting sleeve 80 of the bathtub 10 is unscrewed and removed, and the gasket body 54 is inserted thereon with the sleeve 80 projecting through the central opening 72 and the annular flange 83 overlying the bottom wall 62. The sleeve 80 is then inserted through the drainage outlet opening of the bathtub 10 and is screwed tightly back into the drain pipe 36, as shown in FIG. 3, with the flange 83 compressing the stepped bottom wall portion 74 against the bathtub bottom wall 28 and providing a water-tight seal around the drainage outlet opening 30. The retainer ring 84 is then inserted into the gasket body 54 with the annular flange 86 underlying the top wall 58 and the ring 84 located within the upstanding annular flange 66. The plastic liner 40 is then placed within the existing bathtub 10 and the upstanding annular flange 66 of the gasket body 54 is pulled through the outlet opening 50 of said liner, with the annular flange 68 overlying the liner bottom wall 46, as shown in FIG. 3. The convex strainer plate 92 is then set in position overlying the gasket body 54 and a screw 96 is inserted through the central aperture 94 in strainer plate 92 and turned into the threaded aperture 90 in the bar 88. When the screw 96 is tightened, the strainer plate 92 and ring flange 86 are drawn toward each other, the strainer plate compressing the annular flange 68 against the upper surface of the liner bottom wall 46, and the ring flange 86 compressing the gasket top wall 58 against the lower surface of the liner bottom wall. In addition, the outlet opening 50 of the liner 40 is made of such size that the retainer ring 84 fits tightly therein in the assembled position shown in FIG. 3. The retainer ring 84 compresses the upstanding flange 66 of the gasket body against the peripheral surface of the liner bottom wall 46 bordering the outlet opening 50. Thus, an effective water-tight seal is provided around the outlet opening 50 of the bathtub liner 40.

The gasket assembly provides direct and fluid-tight communication between the outlet opening 50 of the bathtub liner 40 and the drainage outlet opening 30 of the existing bathtub 10. Water draining from the bathtub liner 40 flows through the outlet opening 50 and into the interior of the cylindrical gasket body 52, the water then flowing out through the drainage outlet opening 30 of the existing bathtub 10 via the connected fitting 80, and into the drain pipe 36.

The gasket body 54 is made of material which has the properties of being fungus resistant, flexible and compressible, tear resistant, highly elastic, and resistant to all chemicals used in the bathroom. Preferred materials of this type are silicone, neoprene, or suitable elastomers. Because of the flexibility of the gasket body, it may be readily compressed or stretched and therefore may be mounted in various tub installations where the spacing between the bottom walls of the plastic liner and the existing tub differ appreciably. The gasket assembly is thus extremely versatile in application, and may be used both in refurbishing old installations or for new tub installations.

The tub liner 40 is provided with an overflow aperture 98 in registry with the overflow outlet opening 32 of the existing tub 10. This overflow aperture 98 is coupled to the existing overflow outlet opening 32 of the original bathtub, so that when the tub liner 40 is over-filled with water, above the level of the overflow aperture 98, the excess water will flow through the overflow aperture 98 and the communicating overflow outlet opening 32 of tub 10, then passing through the vertical drain pipe 38 exteriorly of tub 10 to main drain pipe 36 with which vertical drain pipe 38 communicates.

The tub liner 40 is normally supplied as part of a plastic package which also includes wall liners which overlie and cover the walls of the bathtub recess or alcove, and a dome which underlies the ceiling. Specifically, the wall liner assembly includes a central wall liner section 110 and two side wall liner sections 112 and 114, each formed from a flat panel of plastic sheet material. At their upper ends, the side and central wall liner sections 110, 112 and 114 are formed with offset channels 116 which are secured to the underlying walls of the recess or alcove 12 by screws 118, leaving the major portion of the plastic panels spaced from the underlying tile wall 26 of the alcove, as shown in FIG. 1. The dome 120 is preferably formed of the same plastic material as the wall liner sections so as to match the same and provide therewith a unitary bathtub enclosure. The dome 120 comprises a shallow, box-like body 122 bordered by an outwardly-projecting marginal flange 124. The flange 124 is slidably received in the channels 116 of the wall sections 110, 112 and 114 for mounting the dome 120 on the latter.

While the gasket assembly previously described is capable of providing effective sealing around the drainage outlet openings of the bathtub liner and the existing tub under normal circumstances, it is possible that there may be leakage in these areas under normal usage due to improper installation, wear, and other factors. As a result, pure or soapy water may leak into the space between the liner bottom wall 46 and the bottom wall 28 of the existing bathtub, and tend to accumulate there. Water may also leak from the coupling between the bathtub overflow outlet opening 32 and the liner overflow aperture 98, which water flows in the space between the plastic liner 40 and the original bathtub 10, to the bottom thereof. In addition, water may form by condensation, or by seepage of steam, in the spaces between the plastic wall liner panels 110, 112, 114 and the underlying walls 26 of the bathtub recess or alcove, which water flows downwardly in the space between the bottom walls of the bathtub liner and the existing bathtub, and, because of the slope of said bottom walls, tends to accumulate around the outside of the gasket body 54. Such an accumulation of water would result in unwanted odors, soap accumulation, breeding of insects and other conditions which are both undesirable and unhealthy.

Figure 5:
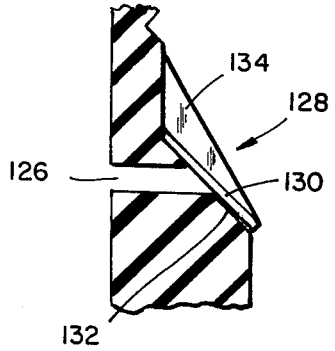
FIG. 5 is a sectional view taken along line 5—5 of FIG. 4.

To prevent accumulation of water in the space between the bottom walls of the tub liner and the existing bathtub, the gasket assembly 52 is provided with one-way valve means to enable such accumulated water to flow into the interior of the gasket body 54 and thereby drain out through the drain pipe 38. As shown in FIGS. 2 and 3, the gasket annular side wall 60 is provided in its lower portion with a plurality of spaced inlet ports 126. Covering over the inner end of each of the inlet ports 126 is a flap valve 128 which has a thin flat flap body 130 made of a flexible elastomeric material which may be the same material from which the gasket body 54 is made. The flap body 130 may be formed integrally with the gasket body, or may be made separate and secured to the inner surface of the gasket body. In any event, the flexible flap body is joined at one end to the inner surface of the gasket side wall 60 in a position to cover over the inner end of its associated inlet port 126, as shown in FIG. 1, and may be easily lifted along its hinged line of connection. In the vicinity of each inlet port 126, the inner surface of side wall 60 is formed with an inclined valve seat surface 132, best shown in FIG. 5, which inclined surface underlies the flap body 130 and is arranged at such an angle that the flap body normally rests flush thereagainst. The flap body 130 may be formed with an integral central rib 134 for the purpose of providing some planar rigidity to the thin flexible flap body 130. One end of the rib 134 is attached to or formed integrally with the inner surface of gasket side wall 60 so that the rib assists in biasing the flap body 130 firmly in closed position against the inclined valve seat surface 132.

The flap valves 128 are effective in preventing water from flowing from the interior of the cylindrical gasket body 54 outwardly through the inlet ports 126. On the other hand, if water accumulates exteriorly of the gasket body in the space between the bottom walls 46 and 28 of the bathtub liner and the existing bathtub 10, the flap valves 128 will open by virtue of the flexibility of the flap bodies 130, and the latter will pivot inwardly along their upper line of connection to positions in which the inner ends of the inlet ports 126 are uncovered. The accumulated water will thus flow through the uncovered inlet ports to the interior of gasket body 54 and will drain out through the outlet fitting 80 and drain pipe 36.

While a preferred embodiment of the invention has been shown and described herein, it is obvious that numerous omissions, changes and additions may be made in such embodiment without departing from the spirit and scope of the invention.

What is claimed is:

1. In a bathtub refurbishing installation in which a plastic bathtub liner is installed within the tub cavity of an existing bathtub with at least a portion of bottom wall of the liner spaced above the bottom wall of the bathtub and a outlet opening in the liner overlying a drainage outlet opening of the bathtub, a gasket assembly for coupling the outlet openings of said liner and bathtub, said gasket assembly including a hollow cylindrical gasket body sized to be inserted in the space between the bottom walls of said liner and said bathtub, first sealing means at the upper end of said gasket body for mounting said upper end in sealed communication with the outlet opening of said plastic liner, and second sealing means at the lower end of said gasket body for mounting said lower end in sealed communication with the drainage outlet opening of said bathtub, said gasket body having a side wall made of elastomeric material and being stretchable and compressible.

2. A gasket assembly according to claim 1 in which said gasket body comprises a cylindrical chamber portion including a flat bottom wall having a central circular aperture therein, a side wall, a flat top wall having a central circular aperture therein with an integral upstanding annular flange bordering the aperture of said top wall and an integral annular flange extending perpendicularly outward from the top end of said upstanding annular flange.

3. A gasket assembly according to claim 2 in which said gasket body and said flanges are molded as an integral unit from elastomeric material.

4. A gasket assembly according to claim 3 in which the side wall of said cylindrical gasket body is accordion pleated whereby said gasket body may be stretched and compressed.

5. A gasket assembly according to claim 3 in which said upstanding annular flange is sized for insertion within the outlet opening of said plastic bathtub liner with said perpendicular annular flange overlying the top surface of the liner bottom wall bordering said outlet opening.

6. A gasket assembly according to claim 5 which also includes a retainer ring sized for insertion within the upstanding annular flange of said gasket body and having an integral annular flange projecting transversely from one end thereof and underlying the top wall of said gasket body, and a flat bar extending diametrically across the central opening of said retainer ring, said bar having a threaded aperture therein.

7. A gasket assembly according to claim 6 which also includes a convex perforated strainer plate sized to overlie the perpendicular annular flange of said gasket body in the mounted position of the latter, and a screw inserted through an opening in said strainer plate and threadedly received in the threaded aperture of said bar, said screw, when tightened, drawing said strainer plate and the annular flange of said retainer ring toward each other, whereby to compress the perpendicular flange of said gasket body against the upper surface of said liner bottom wall and to compress the top wall of said gasket body against the lower surface of said liner bottom wall, thereby providing a water-tight seal around said liner outlet opening.

8. A gasket assembly according to claim 2 in which the drainage outlet opening of said bathtub has a threaded fitting sleeve mounted in said drainage outlet opening and terminating at its top end in an outwardly-projecting annular flange, and in which the bottom wall of said gasket body has an opening communicating with the drainage outlet opening of said bathtub, said second sealing means including a downwardly-stepped surface portion of said gasket body bottom wall surrounding the opening of said bottom wall and positioned to underlie the annular flange of said fitting sleeve.

9. A gasket assembly according to claim 2 which also includes drainage means for draining off water accumulated in the space between the bottom wall of said plastic liner and the bottom wall of said bathtub, said drainage means including at least one inlet port in the side wall of said gasket body, and a one-way valve associated with said inlet port, whereby accumulated water in said space flows through said inlet port into the interior of said gasket body and is discharged therefrom through the communicating drainage outlet opening of said bathtub.

10. A gasket assembly according to claim 9 in which said one-way valve comprises a resilient flap hinged at one end to the interior surface of said gasket body side wall and normally overlying said inlet port for preventing water from passing from the interior of said gasket body through said inlet port to the exterior of said gasket body.

11. A gasket assembly according to claim 9 in which said bathtub refurbishing installation also includes plastic wall liner panels mounted upon and covering over the bathroom walls surrounding said existing bathtub and defining a space between said bathroom walls and said wall liner panels, said space communicating with the space between the bottom walls of said bathtub liner and said bathtub, whereby water condensing in the space between said wall liner panels and bathroom walls seeps into the space between the bottom walls of said bathtub liner and said bathtub as accumulated water which is drained off by said drainage means.

12. In a bathtub refurbishing installation in which a bathtub liner is installed within the tub cavity of an existing bathtub with a least a portion of the bottom wall of the liner spaced above the bottom wall of the bathtub and an outlet opening in the liner overlying a drainage outlet opening of the bathtub, a gasket assembly for coupling the outlet openings of said liner and bathtub, said gasket assembly including a hollow gasket body sized to be inserted in the space between the bottom wall of said liner and said bathtub, first sealing means at the upper end of said gasket body for mounting said upper end in sealed communication with the outlet opening of said plastic liner, and second sealing means at the lower end of said gasket body for mounting said lower end in sealed communication with the drainage outlet of said bathtub, said gasket body having a side wall made of elastromeric material and being stretchable and compressible, said side wall of said gasket body being accordion-pleated, whereby said gasket body may be stretched and compressed.

13. In a bathtub refurbishing installation in which a bathtub liner is installed within the tub cavity of an existing bathtub with at least a portion of the bottom wall of the liner spaced above the bottom wall of the bathtub and an outlet opening in the liner overlying a drainage outlet opening of the bathtub, a gasket assembly for coupling the outlet openings of said liner and bathtub, said gasket assembly including a hollow gasket body sized to be inserted in the space between the bottom wall of said liner and said bathtub, first sealing means at the upper end of said gasket body for mounting said upper end in sealed communication with the outlet opening of said plastic liner, and second sealing means at the lower end of said gasket body for mounting said lower end in sealed communication with the drainage outlet opening of said bathtub, said gasket body having a side wall made of elastomeric material and being stretchable and compressible, and drainage means for draining off water accumulated in the space between the bottom wall of said plastic liner and the bottom wall of said bathtub, said drainage means including at least one inlet port in said side wall of said gasket body, and a one-way valve associated with said inlet port, whereby accumulated water in said space flows through said inlet port into the interior of said gasket body and is discharged therefrom through the communicating drainage outlet opening of said bathtub.

14. In a bathtub refurbishing installation in which a bathtub liner is installed within the tub cavity of an existing bathtub with at least a portion of the bottom wall of the liner spaced above the bottom wall of the bathtub and an outlet opening in the liner overlying a drainage outlet opening of the bathtub, a gasket assembly for coupling the outlet openings of said liner and bathtub, said gasket assembly including a hollow gasket body sized to be inserted in a space between the bottom walls of said liner and said bathtub, first sealing means at the upper end of said gasket body for mounting said upper end in sealed communication with the outlet opening of said plastic liner, and second sealing means at the lower end of said gasket body for mounting said lower end in sealed communication with the drainage outlet opening of said bathtub, said gasket body having a side wall provided with at least one inlet port, and a one-way valve associated with said inlet port, whereby accumulated water in said flows through said inlet port into the interior of said gasket body and is discharged therefrom through the communicating drainage outlet opening of said bathtub.

* * * * *

UNITED STATES PATENT AND TRADEMARK OFFICE

CERTIFICATE OF CORRECTION

PATENT NO. : 4,267,609

DATED : May 19, 1981

INVENTOR(S) : Altman, et al.

It is certified that error appears in the above-identified patent and that said Letters Patent are hereby corrected as shown below:

Column 9, line 15, after "outlet" insert the word --opening--

Column 10, line 36, after the word "said" insert the word --space--.

Signed and Sealed this

*Third* Day of *August 1982*

[SEAL]

*Attest:*

GERALD J. MOSSINGHOFF

*Attesting Officer*

*Commissioner of Patents and Trademarks*